US006793314B2

(12) United States Patent
Galbraith et al.

(10) Patent No.: US 6,793,314 B2
(45) Date of Patent: Sep. 21, 2004

(54) CLEANING INK JET PRINT HEADS USING ULTRA-VIOLET AND GREEN ND-YAG LASERS

(75) Inventors: Francis T. Galbraith, Beavercreek, OH (US); James E. Harrison, Jr., Dayton, OH (US); Michael R. Morrissey, Dayton, OH (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/916,991

(22) Filed: Jul. 27, 2001

(65) Prior Publication Data

US 2004/0032449 A1 Feb. 19, 2004

(51) Int. Cl.[7] ..... B41J 2/165
(52) U.S. Cl. ..... 347/22

(58) Field of Search ..... 347/22, 25–28, 347/42–47; 359/341.1, 341.31, 204; 430/125, 945; 264/400

(56) References Cited

U.S. PATENT DOCUMENTS 5,528,350 A * 6/1996 Tanaka et al. ..... 399/45
5,642,145 A * 6/1997 Tanaka et al. ..... 347/111

* cited by examiner

*Primary Examiner*—Shih-Wen Hsieh
(74) *Attorney, Agent, or Firm*—Barbara Joan Haushalter

(57) ABSTRACT

A method and apparatus are provided for removing contaminates from ink jet printer components. The normal output from a Nd-YAG laser is frequency multiplied to be capable of removing particulates and films from ink jet printer components. The laser cleaning technique provides a dramatic effect on yields.

15 Claims, 1 Drawing Sheet

CLEANING INK JET PRINT HEADS USING ULTRA-VIOLET AND GREEN ND-YAG LASERS

TECHNICAL FIELD

The present invention relates to laser cleaning and, more particularly, to the use of ultraviolet and green Nd-YAG lasers for the purpose of cleaning ink jet printheads.

BACKGROUND ART

Ink jet printing systems are known in which a print head defines one or more rows of orifices which receive an electrically conductive recording fluid, such as for instance a water based ink, from a pressurized fluid supply manifold and eject the fluid in rows of parallel streams. Printers using such print heads accomplish graphic reproduction by selectively charging and deflecting the drops in each of the streams and depositing at least some of the drops on a print receiving medium, while others of the drops strike a drop catcher device.

Epoxy film and epoxy particles are generated during the attachment of the orifice plate to the droplet generator. The solid particles can be deposited by manufacturing processes or contamination from use of the product. It is well known that ink jet printers are sensitive to contamination by particulates and thin films around the orifices from which the ink is jetted. Such contaminates can lead to failure of the printhead during manufacture. Contaminates can also produce premature failure during operation of the printhead. In the current art, such contaminates have typically been removed by scrubbing or other tactile contact with the components. Unfortunately, such methods of contaminate removal can cause physical damage to the ink jet components, adversely affecting yields by increasing costs associated with the manufacture and maintenance of ink jet printheads.

It would be desirable then to be able to provide an improved method for removing such contaminates from printhead components, and thereby improve yields.

SUMMARY OF THE INVENTION

The present invention proposes the use of ultraviolet and green Nd-YAG lasers to clean ink jet printheads by removing contaminates from print head components. The laser cleaning technique of the present invention is useful during manufacture of printheads, increasing manufacturing yields. It is also useful for restoring printheads which have failed during operation.

In accordance with one aspect of the present invention, a method and apparatus are provided for removing contaminates from ink jet printer components. The normal output from a Nd-YAG laser is frequency multiplied to be capable of removing particulates and films from ink jet printer components. The laser cleaning technique provides a dramatic effect on yields.

Other objects and advantages of the invention will be apparent from the following description, the accompanying drawings and the appended claims.

DETAILED DESCRIPTION OF THE PREFERRED EMBODIMENTS

The present invention proposes use of an ultraviolet and green Nd-YAG laser for the purpose of cleaning ink jet printheads and ink jet components. During print head manufacture and use, particulates and thin films can collect around the orifices from which the ink is jetted. They can also collect on the charging electrodes used to select which drops formed from the jetted ink are to strike the print media or to be collected by the printhead catcher or gutter means. The orifice plate which includes these orifices as features and the charge plate which includes the charging electrodes as features are two components that can be cleaned by the present invention. The laser cleaning technique of the present invention is capable of removing ink film, epoxy films, solid particles, and any other contaminate except actual physical damage to the components.

Figure 1:
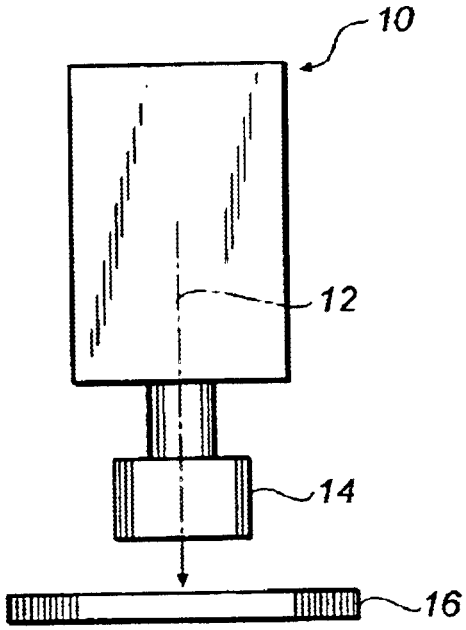
FIG. 1 illustrates the arrangement of the laser cleaning apparatus of the present invention and the part requiring cleaning.

In accordance with the present invention, the laser cleaning apparatus 10 of FIG. 1 comprises a frequency multiplied Nd:YAG laser that is beamed along a laser path 12. When the frequency of the normal output from the Nd-YAG laser light is doubled, a green laser light is produced. When the frequency of the normal output from the Nd-YAG laser light is tripled, ultraviolet (UV) laser light is produced. Both the green and the UV light can be used for cleaning. Generally, the green laser light is particularly well suited for removing particulates, such as inorganic salts, dye residues, and paper debris, while the ultraviolet laser light is particularly well suited for removing organic films. The frequency multiplied Nd-YAG laser is preferred for this application because it can provide the power desired, the pulse widths desired, the choice of operating frequency, its ease of use, and cost. Other lasers, such as an excimer laser for the UV, can be much more difficult to operate, and would require a separate laser to provide the green light.

Continuing with FIG. 1, the laser light along path 12 is directed through an objective lens 14 to focus the beam of light toward the part or component 16 to be cleaned. In a preferred embodiment, the laser has frequency multiplying components integrated into the laser. The operator can make a determination as to the frequency necessary to clean the component, based on the type of contaminant seen. Alternatively, the green laser light can be swept across the component and then, if necessary, the ultraviolet light can be swept across the component if further cleaning is necessary.

Figure 2:
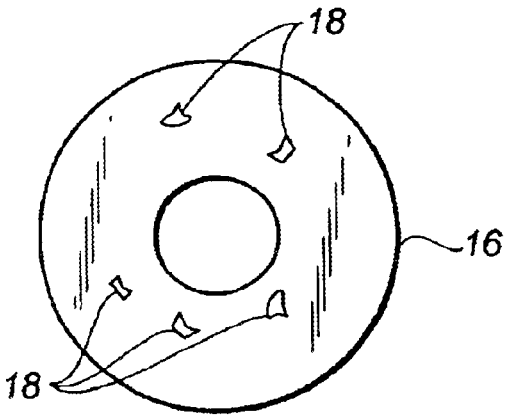
FIG. 2 is a magnified illustration of and orifice plate nozzle before being cleaned using the apparatus of FIG. 1.
Figure 3:
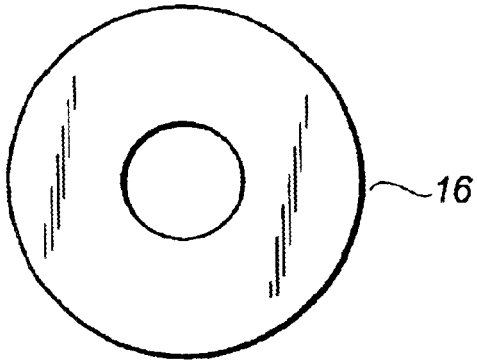
FIG. 3 is a magnified illustration of the orifice plate nozzle of FIG. 2 after being cleaned by the laser cleaning apparatus of FIG. 1.

The laser cleaning technique of the present invention can be used during production and refurbishment of printheads to remove contaminates. In FIG. 2, there is illustrated an orifice plate nozzle as the component 16 to be cleaned. Contaminates 18 have collected on the orifice plate nozzle 16. These contaminates 18 can lead to failure of the printhead during manufacture and operation. As will be obvious to those skilled in the art, the component 16 and the contaminates 18 are magnified in FIGS. 2 and 3. Typically, an orifice plate nozzle and the debris collected thereon are almost impossible to see with the naked eye. The laser cleaning apparatus 10 of FIG. 1 can be used to remove the contaminates 18 without causing physical damage to the component 16. After application of the laser cleaning technique of the present invention to the contaminates of FIG. 2, the orifice plate nozzle is clean, as illustrated in FIG. 3.

To clean a component 16 with frequency multiplied wavelengths, a pulse width of five to ten nanoseconds is preferred. The pulse preferably supplies 300 to 3000 microjoules of energy. At energy levels below 300 microjoules, cleaning has been found to be ineffective; while at energy levels above 3000 microjoules, damage to the components can occur.

In accordance with one aspect of the present invention, the laser cleaning system can be coupled into a microscope, having appropriate filters to protect the operators eyes from the reflected laser light. This allows the operator to view the surface to be cleaned to confirm that the cleaning is effective. In this system, the spot size of the laser is variable, both before and during the sweep, and can be controlled by an aperture. A spot size that can clean the entire wettable surface around a jetting orifice is a convenient spot size. Hence, the spot size is selected by marking an area large enough to clean the contamination.

In an alternative embodiment, optical fiber means can be employed to direct the laser cleaning energy to the ink jet components. Such optical fiber means may allow the laser cleaning energy to be employed on components or features not accessible to cleaning with a microscope coupled laser cleaning system.

The laser light is output at a pulse rate of up to 40 Hz, but is mainly dependent on the machine speed limitations. At a pulse rate of up to 40 Hz, a single pulse per hole is normally sufficient for cleaning, although additional pulses can be applied as needed. The drop generator can then be indexed to allow the next orifice to be cleaned, and the laser pulsed. Alternatively, the laser can be made to pulse continuously and the part 14 be continuously scanned past the laser. With a maximum pulse rate of 40 Hz for the laser, a scan rate of five minutes per foot has been found to be effective.

For component cleaning purposes in accordance with the present invention, the laser light can be applied at any suitable angle, such as incident at right angles to the surface, or smaller angles. The cleaning using laser light is effective without requiring a cross flow of air or gas. It will be obvious to those skilled in the art that the laser cleaning technique of the present invention can be applied in a variety of environments and manners without departing from the scope of the invention. For example, the laser cleaning technique of the present invention can be used on all parts or only when a failure of a part has occurred. Additionally, the technique may be applied as a manual or automatic process. An automated process can include automated means to set from orifice to orifice, while applying the laser pulses. It could further include vision system means to inspect the ink jet components to identify orifices or other ink jet component features which should be laser cleaned, and applying the laser cleaning energy only to those features. Such a vision system could then inspect the component to determine the effectiveness of the laser cleaning, and apply further laser cleaning, perhaps with the second wavelength, as needed. The laser cleaning apparatus of the present invention has the advantage of improving yields, reducing the failure rate of printheads by 50% to 75%.

The invention has been described in detail with particular reference to certain preferred embodiments thereof, but it will be understood that modifications and variations can be effected within the spirit and scope of the invention.

What is claimed is:

1. A method for removing contaminates from ink jet printer components, comprising the steps of:

providing a Nd-YAG laser, the Nd-YAG laser capable of generating an output;

frequency multiplying the Nd-YAG laser output to generate various beams;

applying various beams of the frequency multiplied Nd-YAG laser output to the ink jet printer components to remove contaminates on the ink jet printer components.

2. A method as claimed in claim 1 wherein the step of frequency multiplying the Nd-YAG laser output comprises the step of approximately doubling the laser output to produce a green laser light.

3. A method as claimed in claim 1 wherein the step of frequency multiplying the Nd-YAG laser output comprises the step of approximately tripling the laser output to produce an ultraviolet laser light.

4. A method as claimed in claim 1 wherein the step of applying the frequency multiplied Nd-YAG laser output further comprises the step of applying a pulsed laser output.

5. A method as claimed in claim 1 wherein the step of applying the frequency multiplied Nd-YAG laser output further comprises the step of applying greater than 300 microjoules pulses to the ink jet components.

6. A method as claimed in claim 1 wherein the step of applying the frequency multiplied Nd-YAG laser output further comprises the step of applying less than 3000 microjoules pulses to the ink jet components.

7. A method as claimed in claim 1 wherein the ink jet printer components comprises an orifice plate.

8. A method as claimed in claim 1 wherein the ink jet printer components comprises a charge plate.

9. An apparatus for removing contaminates from ink jet printer components, comprising:

a Nd-YAG laser, the Nd-YAG laser capable of generating an output;

means for frequency multiplying the Nd-YAG laser output;

means for applying the frequency multiplied Nd-YAG laser output to the ink jet printer components to remove contaminates on the ink jet printer components.

10. An apparatus as claimed in claim 9 wherein the means for frequency multiplying the Nd-YAG laser output comprises means for approximately doubling the laser output to produce a green laser light.

11. An apparatus as claimed in claim 9 wherein the means for frequency multiplying the Nd-YAG laser output comprises means for approximately tripling the laser output to produce an ultraviolet laser light.

12. An apparatus as claimed in claim 9 further comprising a microscope coupled thereto for viewing the ink jet printer components being cleaned.

13. An apparatus as claimed in claim 9 further comprising a means coupled to the apparatus for inspecting the ink jet printer components to be cleaned.

14. An apparatus as claimed in claim 13 wherein laser cleaning is selectively applied to the ink jet components as determined by the inspection means.

15. An apparatus as claimed in claim 9 wherein the means for applying comprises optical fiber means for directing the Nd-YAG laser output.

* * * * *